US005114210A

United States Patent [19]

Naess

[11] Patent Number: 5,114,210

[45] Date of Patent: May 19, 1992

[54] TILTING CHAIR WITH IMPROVED LUMBAR SUPPORT

[75] Inventor: Johan H. Naess, Hazelbrook, Australia

[73] Assignee: Maxton Fox Commercial Furniture Pty. Ltd., New South Wales, Australia

[21] Appl. No.: 576,400

[22] PCT Filed: Jan. 11, 1990

[86] PCT No.: PCT/AU90/00007

§ 371 Date: Sep. 10, 1990

§ 102(e) Date: Sep. 10, 1990

[87] PCT Pub. No.: WO90/07887

PCT Pub. Date: Jul. 26, 1990

[30] Foreign Application Priority Data

Jan. 11, 1989 [AU] Australia ..... PJ2242

[51] Int. Cl.[5] ..... A47C 3/00

[52] U.S. Cl. ..... 297/300; 297/301

[58] Field of Search ..... 297/300, 301, 316, 320, 297/353, 354, 296

[56] References Cited

U.S. PATENT DOCUMENTS

| | | | |
|---|---|---|---|
| 4,084,850 | 4/1978 | Ambasz | 297/300 |
| 4,451,085 | 5/1984 | Franck et al. | 297/300 X |
| 4,529,247 | 7/1985 | Stumpf et al. | 297/300 X |
| 4,711,491 | 12/1987 | Ginat | 297/301 |
| 4,744,600 | 5/1988 | Inoue | 297/300 X |
| 4,889,385 | 12/1989 | Chadwick et al. | 297/301 X |

FOREIGN PATENT DOCUMENTS

| | | | |
|---|---|---|---|
| 3617539 | 7/1987 | Fed. Rep. of Germany | 297/300 |

*Primary Examiner*—Laurie K. Cranmer
*Attorney, Agent, or Firm*—Limbach & Limbach

[57] ABSTRACT

A chair comprising a frame having a seat portion and a back portion is adapted to support the trunk of the body of an occupant. The frame is supported on a base. The chair includes a mechanism for allowing that part of the body portion supporting the upper trunk of the body of the occupant to tilt relative to that part of the back portion supporting the lower trunk of the body of the occupant and the seat portion. The chair also includes a mechanism for allowing the seat portion to tilt relative to the base. The tilt axis is located underneath and substantially adjacent to the anterior end of the seat portion. The back portion includes a pair of oppositely disposed tubular arms that define side members of the frame. Each of the tubular arms is discontinuous at a point adjacent the lumbar region of the seated occupant. The back portion tilting mechanism comprises a pair of coiled springs each tightly inserted within the respective tubular arm and extending across the respective point of discontinuity. The chair further includes a mechanism for controlling the angle of tilt of each of the tubular arms. The controlling mechanism comprises an elongated spring member having its ends anchored into the anterior face of its respective tubular arm immediately above and below the corresponding location of its respective inserted coil spring. The portion of the spring member intermediate its anchored ends is arched outwardly from the anterior face of the tubular member. This arrangement is such that the extent of tilt of each of the tubular arms is dependant on the location of the anchored ends and the clearance of the arched connecting portion of the spring member from the anterior face of the tubular member.

8 Claims, 3 Drawing Sheets

TILTING CHAIR WITH IMPROVED LUMBAR SUPPORT

FIELD OF THE INVENTION

The present invention relates to tilting chairs

BACKGROUND ART

Hitherto, tilting chairs have generally incorporated a tilt mechanism independent of the frame, the tilt axis of which was located approximately midway along and underneath the seat, or otherwise substantially distant from the anterior end of the seat These chairs respond to the backward leaning of the seated occupant by simultaneous movement of both the seat portion and the back portion This often causes the occupants knees (bent over the anterior end of the seat) to rise upwardly to a height where they collide with an accompanying desk, and the lower trunk of the occupants body to sink into the posterior part of the seat, so restricting the further stretching out of the occupant. Furthermore, the leaning back of the seated occupant on such chairs causes additional pressure to the underside of the thighs of the occupant, so restricting blood circulation.

It would therefore be advantageous to develop a chair that would allow the back, and particularly the region of the back above the lumbar, of the seated occupant to be stretched or arched backwards comfortably without causing simultaneous lifting of the legs and feet of the user.

It is an object of the present invention to overcome or substantially ameliorate the abovementioned disadvantages of the prior art.

DISCLOSURE OF INVENTION

In accordance with the present invention, there is provided a chair comprising:

(i) a frame having a seat portion and a back portion adapted to support the trunk of the body of an occupant, said frame being supported on a base, and (ii) means for allowing that part of the back portion supporting the upper trunk of the body of the occupant to tilt relative to that part of the back portion supporting the lower trunk of the body of the occupant and seat portion.

Preferably, the chair further comprises means for allowing the seat portion to tilt relative to the base, wherein the tilt axis is located underneath and substantially adjacent to the anterior end of the seat portion.

According to another aspect of the invention there is provided a chair having a seat mounted on a base and including means for allowing the seat portion to tilt relative to the base, wherein the tilt axis is located underneath and substantially adjacent to the anterior end of the seat portion.

Preferably, the seat tilting means includes a pair of vertically spaced apart substantially U-shaped support members, the upper support member supporting the anterior end of the seat portion, the lower support member being supported by the base, each free arm of the upper support member being connected to its corresponding free arm of the lower support member by a flexible U-shaped connecting member, the arrangement being such that with the application of weight by the seated occupant, the upper support member will move through an arc relative to the fixed position of the lower support member by bending of both of the connecting members.

BRIEF DESCRIPTION OF THE DRAWINGS

In order that the invention may be more readily understood and put into practical effect, reference will now be made to the accompanying drawings in which.

DESCRIPTION OF PREFERRED EMBODIMENTS

Figure 1:
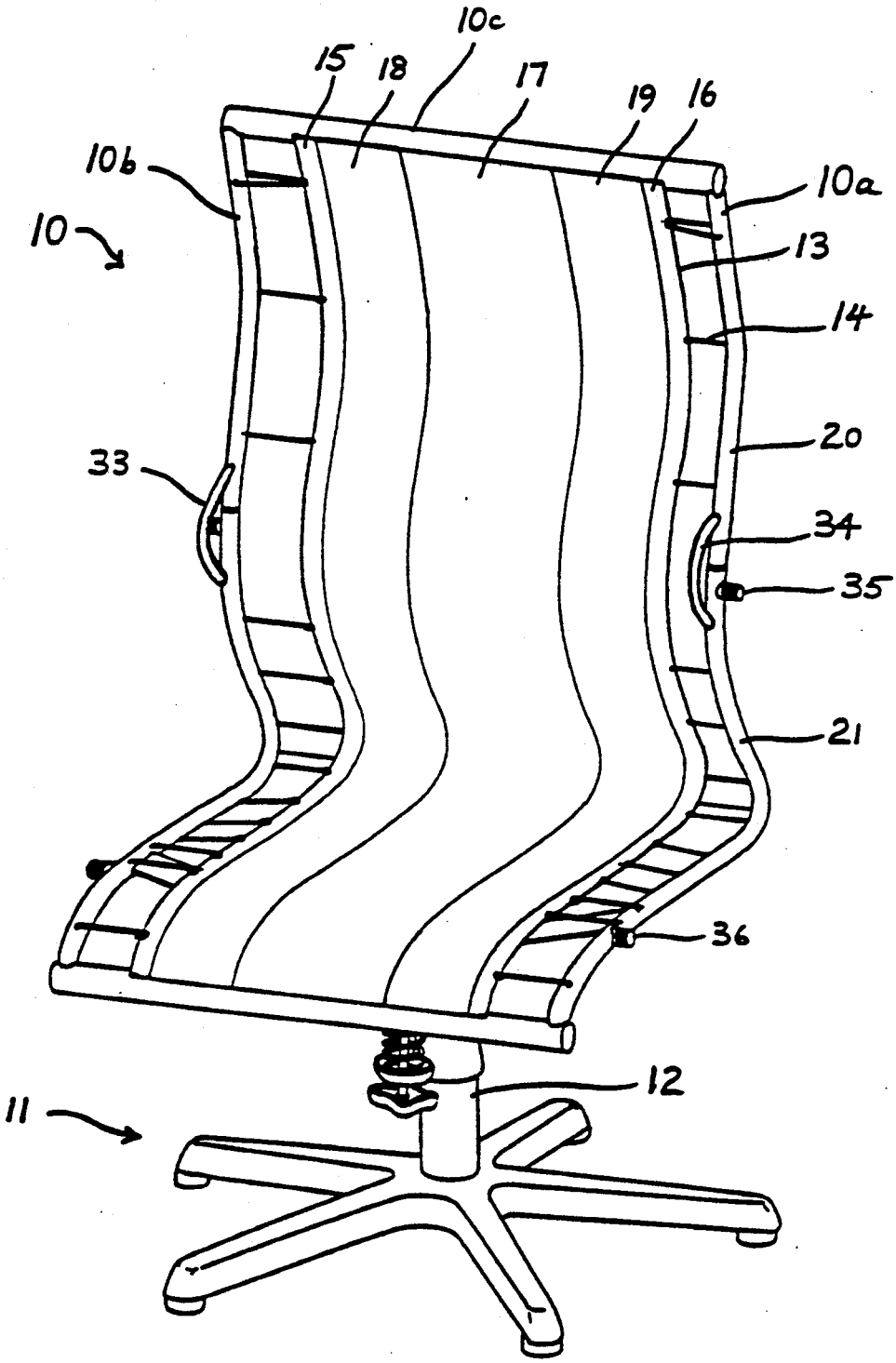
FIG. 1 is a perspective view of the frame and base of a chair according to a preferred embodiment of the invention.

The frame and base of FIG. 1 has a main frame 10 mounted on a base 11 upon which the main frame 10 is adapted to swivel about shaft 12. The main frame 10 supports the backing fabric 13 by way of pins 14 which are hooked at both ends. The site of attachment of each pin 14 to fabric 13 and frame 10 is specially selected to maintain the contour of the backing fabric 13 with respect to the main frame 10. The backing fabric 13 is divided into five parts, the outermost parts 15 and 16 and the innermost part 17 consist of a polypropylene mesh, whilst the regions 18 and 19 consist of a rubber strip heat sealed to the adjacent meshwork for reinforcement of the backing fabric.

The main frame 10 which is comprised of side members 10*a*, 10*b* connected together by cross piece 10*c* is divided into two parts capable of limited independent movement; these are the upper part of the back portion 20 and the lower part of the back portion with seat portion 21 The role of these two parts of the main frame 10 will be described with reference to FIG. 2.

Figure 2:
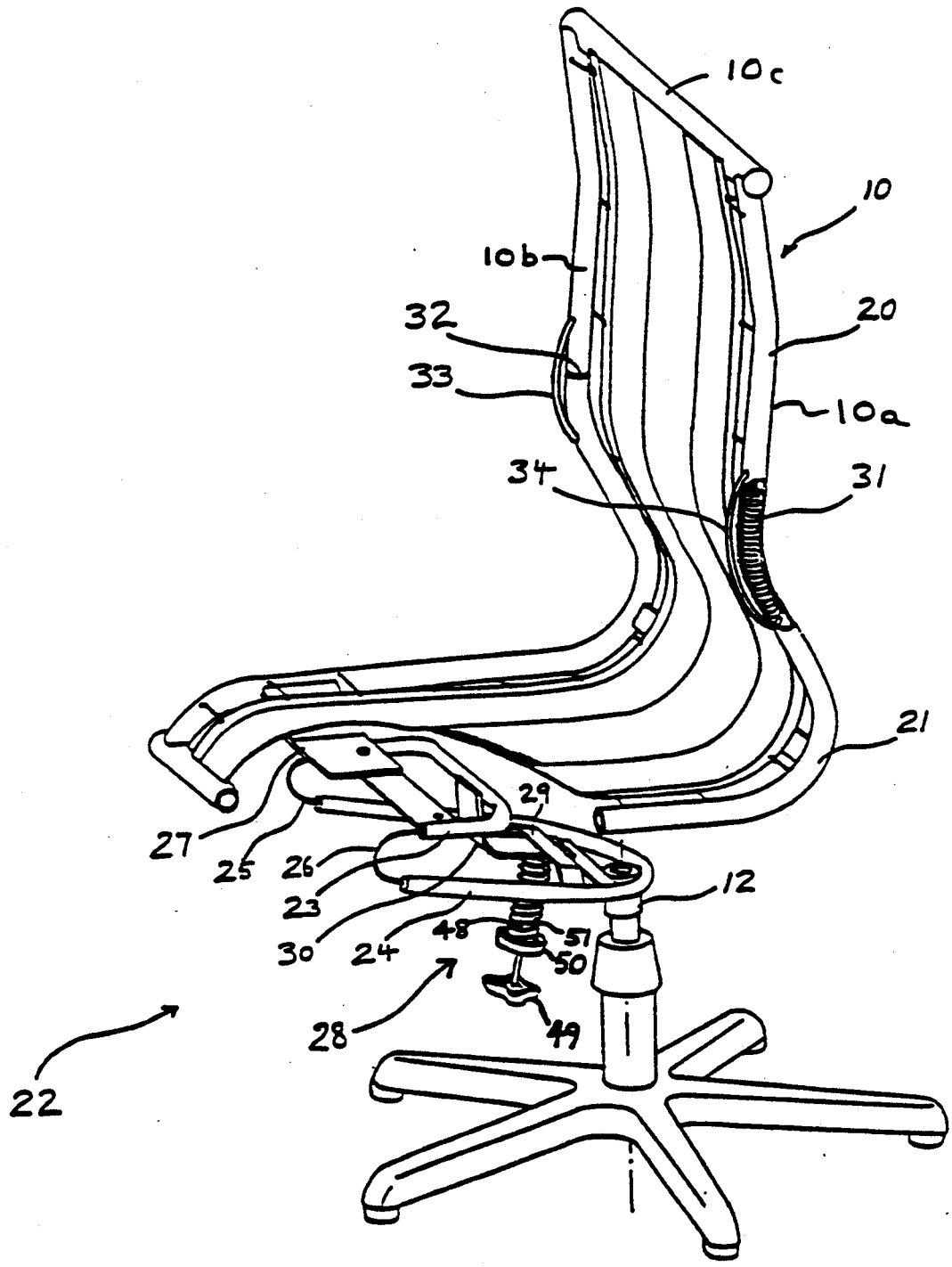
FIG. 2 is an isometric side view of the frame and base of the chair of FIG. 1 with the seat portion partially cut-away to show the seat tilting means and showing the means for tilting of the back portion.

The seat tilting means 22 shown in FIG. 2 includes two substantially U-shaped support members 23 and 24. The upper support member 23 is adapted to move through an arc relative to the fixed position of the lower support member 24 by the weight of the seated occupant, the movement occurring through bending of U-shaped connecting members 25 and 26. The upper support member 23 is fixedly connected to the frame 10 through a base plate 27 (partly shown). The lower support member 24 is fixedly connected to the shaft 12.

The degree of tension in the bending of the upper support member 23 with respect to the lower support member 24 can be adjusted by spring tensioning means 28. A crossmember 29 fixedly connects the two arms of the lower support member 24. An L-shaped member 30 is fixedly connected to the upper support member 23 and projects outwardly such that its base end extends beneath and abuts against the cross member 29. Moulded to the cross member 29 is a shaft 48 which extends downwardly through an aperture (not shown) in the base end of the member 30. The shaft 48 has a threaded portion (not shown) at its end remote of the cross member 29 which screwably engages the correspondingly threaded bore of a screw cap 49. The screw cap 49 has a dished plate 50 concentrically housed about a portion of its bore. The dished plate 50 is engaged to the bore of the screw cap 49 in such a way that it will travel longitudinally with the bore along the threaded portion of the shaft 48 whilst remaining rotationally stationary. A coiled spring 51 envelopes the shaft 48 and its uppermost end abuts against the lower surface of the base end of the L-shaped member 30 and its other end abuts against the depressed surface of the dished plate 50.

With this arrangement the pressure applied by the base end of the L-shaped member 30 against the cross member 29 may be adjusted by turning of the screw cap 49, thereby allowing the spring tensioning means 28 to adjust the tension between the upper and lower U-shaped support members 23 and 24, and allowing for variation in the tilting tension of the lower part of the back portion with seat portion 21.

As also shown in FIG. 2, the means for tilting the upper part of the back portion 20 relative to the lower part of the back portion with seat portion 21 consists of a pair of coiled springs (only 31 shown) located tightly within opposite arms or side members 10*a* and 10*b* of the frame 10 that supports the occupant's back. The opposite tubular arms 10*a* and 10*b* of the frame 10 are discontinuous at a point that corresponds to the position supporting the lumbar region of the seated occupant. Extending across each of the discontinuous points is the respective inserted coiled spring, and the discontinuous gaps (only 32 shown in FIG. 2; that exist are of sufficient dimension to allow that part of the frame 10 above the gaps, (the portion 20), to tilt relative to that part of the frame 10 below the gaps, (the portion 21). Ideally, the gaps should be covered by flexible protective material such as masking tape.

A pair of elongated spring members in the form of spring steel wires 33 and 34 are secured to the frame 10 as shown by having their ends bent slightly acutely into holes located at the anterior face of the frame 10 and immediately above and below the corresponding location of each inserted spring (only 31 shown). For each spring wire (such as 34), the position of the two holes by which it is secured to the frame 10 and the degree to which the ends of the spring wire entering the bore of the frame are bent backwards are such as to ensure that the adjacent inserted spring 31 does not wander up or down the bore of the frame that houses it under the effect of continued bending of the upper part of the back portion 20 with respect to the lower part of the back portion with seat portion 21.

As well, the spring steel wires 33 and 34 serve to ensure that the upper part of the back portion 20 remains at a constantly fixed distance from the lower part of the back portion with seat portion 21 whenever there is no backward pressure applied to the portion 20, as a gradual slipping away of the portion 20 from the portion 21 along the inserted spring (only 31 shown) may otherwise occur with continued bending of these parts.

The portion of each spring wire 33 and 34 that emerges from the holes in the frame 10 is arched slightly outwardly from the anterior surface of the frame adjacent thereto. The maximum clearance between each spring wire and frame is of such magnitude that it sets the desired range of angulation between the upper and lower parts of the back portion 20 and 21 respectively. As the upper part of the back portion 20 bends with respect to the lower part of the back portion with seat portion 21, each spring wire will similarly bend but only to the extent where the arched portion of each wire rigidly contacts against the anterior face of the frame 10. In this way, the maximum angulation between the portions 20 and 21 is determined, in the main, by the clearance of the spring wires 33 and 34 from the frame 10.

Figure 3:
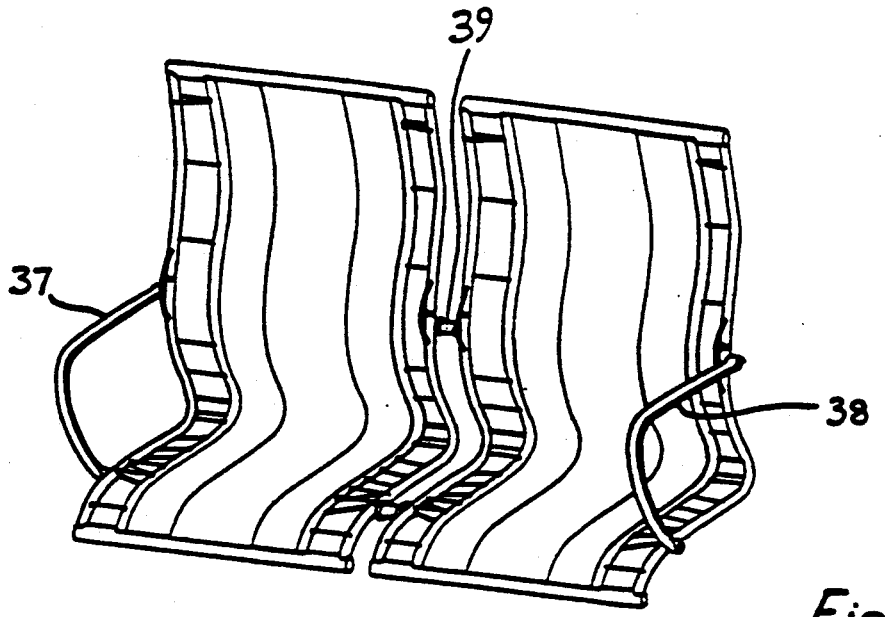
FIG. 3 is a perspective view of two adjoining chair frames, each chair frame operating according to the embodiment of FIG. 2.

The two adjoining chair frames of FIG. 3 are connected in part through the threaded projections 35 and 36 shown in FIG. 1. In the embodiment of FIG. 1, these projections would be used to secure arm rests (not shown in FIG. 1), but the position of such arm rests 37 and 38 can be seen in FIG. 3.

Figure 4:
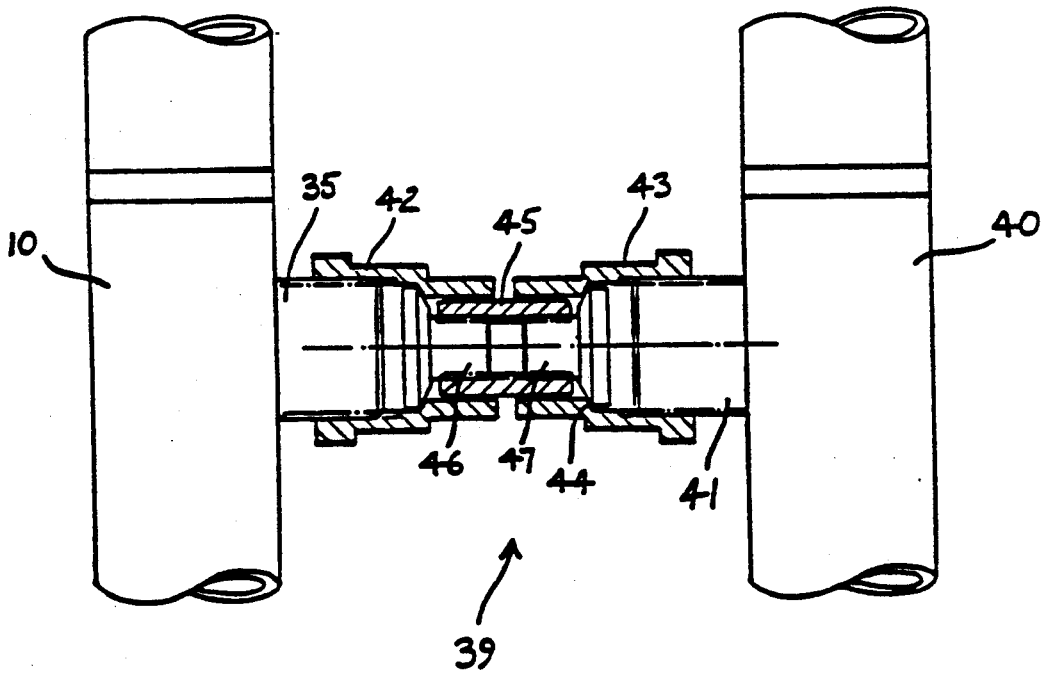
FIG. 4 is a partly cross-sectional side view of the joining assembly for the adjoining chair frames of FIG. 3.

A single joining assembly 39 for the adjoining chair frames of FIG. 3 is shown in detail in FIG. 4. The two adjacent frames 10 and 40 have threaded projections 35 and 41 that receive the partly threaded bore of sleeves 42 and 43 (shown in section). Each sleeve also has an unthreaded narrowed portion which, in the configuration shown, faces the narrowed portion of the other sleeve. The unthreaded narrowed portion is separated from the threaded portion of each sleeve by a circumferential wall 44. In their opposing juxtaposition, the unthreaded portions receive a hollowed cylindrical member 45 therebetween (shown in section) that is threaded only on its inner surface. Two screws 46 and 47, separately inserted against the walls of each sleeve and threaded within the joining cylinder 45, secure the two sleeves 42 and 43 together, thereby providing firm connection between any two adjoining chairs.

Various modifications may be made in details of design and construction without departing from the scope or ambit of the invention. For example, the main frame could consist of a sole upright member rather than the two spaced apart upright members 10*a* and 10*b*.

I claim:

1. A chair comprising a frame having a seat portion and a back portion adapted to support the trunk of the body of an occupant, said frame being supported on a base, and means for allowing that part of the back portion supporting the upper trunk of the body of the occupant to tilt relative to that part of the back portion supporting the lower trunk of the body of the occupant and seat portion, and means for allowing the seat portion to tilt relative to the base, wherein the tilt axis is located underneath and substantially adjacent to the anterior end of the seat portion, the back portion including a pair of oppositely disposed tubular arms that define side members of the frame, each of the said tubular arms being discontinuous at a point adjacent the lumbar region of the seated occupant, the back portion tilting means comprising a pair of coiled springs each tightly inserted within the respective tubular arm and extending across the respective point of discontinuity, and further including means for controlling the angle of tilt of each of the said tubular arms, said controlling means comprising an elongated spring member having its ends anchored into the anterior face of its respective tubular arm immediately above and below the corresponding location of its respective inserted coiled spring, the portion of the spring member intermediate its anchored ends being arched outwardly from the anterior face of the tubular member, the arrangement being such that the extent of tilt of each of the said tubular arms is dependent on the location of the anchored ends therealong and the clearance of the arched connecting portion of the spring member from the anterior face of the tubular member.

2. The chair of claim 1 wherein the seat tilting means includes a pair of vertically spaced apart substantially U-shaped support members, the upper support member supporting the anterior end of the seat portion, the lower support member being supported by the base, each free arm of the upper support member being connected to its corresponding free arm of the lower support member by a flexible U-shaped connecting member, the arrangement being such that with the application of weight by the seated occupant, the upper support member will move through an arc relative to the fixed position of the lower support member by bending of both of the connecting members.

3. The chair of claim 2 further including means for adjusting the tension in the arcuate movement of the upper support member relative to the lower support member.

4. The chair of claim 3 wherein the tension adjustment means includes a substantially L-shaped member connected at its upper end to the upper support member and having its base end abutting against the underside of a cross member connecting the arms of the lower support member, the said cross member having a shaft fixed thereto and extending downwardly through an aperture in the base end, the shaft having a threaded portion at its end remote of the cross member to screwably engage the correspondingly threaded bore of a screw cap, the screw cap having a dished plate located concentrically about a portion of the bore and adapted to travel longitudinally with the bore along the threaded portion whilst remaining rotationally stationary, a coiled spring surrounding the said shaft and having its uppermost end abutting against the lower surface of the base end of the L-shaped member and having its other end abutting against the surface of the dished plate, the arrangement being such that the pressure applied by the base end of the L-shaped member against the cross member may be adjusted by turning of the screw cap and resultant compression or expansion of the coiled spring.

5. A plurality of adjoining chairs wherein each chair is according to claim 1 and includes an arm rest anchor located on each of said tubular arms, the adjoining chairs being joined at positions along their frames corresponding to the sites of the arm rest anchors.

6. A chair having a seat mounted on a base and including means for allowing the seat portion to tilt relative to the base, wherein the tilt axis is located underneath and substantially adjacent to the anterior end of the seat portion, the seat tilting means including a pair of vertically spaced apart substantially U-shaped support members, the upper support member supporting the anterior end of the seat portion, the lower support member being supported by the base, each free arm of the upper support member being connected to its corresponding free arm of the lower support member by a flexible U-shaped connecting member, the arrangement being such that with the application of weight by the seated occupant, the upper support member moves through an arc relative to the fixed position of the lower support member by bending of both of the connecting members.

7. The chair of claim 6 further including means for adjusting the tension in the arcuate movement of the upper support member relative to the lower support member.

8. The chair of claim 7 wherein the tension adjustment means includes a substantially L-shaped member connected at its upper end to the upper support member and having its base end abutting against the underside of a cross member connecting the arms of the lower support member, the said cross member having a shaft fixed thereto and extending downwardly through an aperture in the base end, the shaft having a threaded portion at its end remote of the cross member to screwably engage the correspondingly threaded bore of a screw cap, the screw cap having a dished plate located concentrically about a portion of the bore and adapted to travel longitudinally with the bore along the threaded portion whilst remaining rotationally stationary, a coiled spring surrounding the said shaft and having its uppermost end abutting against the lower surface of the base end of the L-shaped member and having its other end abutting against the surface of the dished plate, the arrangement being such that the pressure applied by the base end of the L-shaped member against the cross member may be adjusted by turning of the screw cap and resultant compression or expansion of the coiled spring.

* * * * *